United States Patent [19]

Pringle

[11] Patent Number: 4,724,908

[45] Date of Patent: Feb. 16, 1988

[54] CIRCULATING KILL VALVE

[75] Inventor: Ronald E. Pringle, Houston, Tex.

[73] Assignee: Camco, Incorporated, Houston, Tex.

[21] Appl. No.: 915,220

[22] Filed: Oct. 3, 1986

[51] Int. Cl.[4] ..... E21B 34/10; E21B 34/14

[52] U.S. Cl. ..... 166/317; 166/319; 166/332

[58] Field of Search ..... 166/317, 319, 321, 322, 166/323, 324, 332

[56] References Cited

U.S. PATENT DOCUMENTS

| | | | |
|---|---|---|---|
| 3,025,919 | 3/1962 | Angel et al. | 166/321 |
| 4,399,871 | 8/1983 | Adkins et al. | 166/321 |
| 4,566,478 | 1/1986 | Deaton | 166/323 |

FOREIGN PATENT DOCUMENTS

| | | | |
|---|---|---|---|
| 2600252 | 7/1976 | Fed. Rep. of Germany | 166/321 |
| 0560964 | 7/1977 | U.S.S.R. | 166/319 |

OTHER PUBLICATIONS

G. M. Raulins, "Platform Safety by Downhole Well Control", 10-3-1971, *SPE Meeting,* pp. 1-9.

*Primary Examiner*—Stephen J. Novosad
*Assistant Examiner*—Terry Lee Melius
*Attorney, Agent, or Firm*—Fulbright & Jaworski

[57] ABSTRACT

A circulating kill valve having a body with an initially closed port which is opened in response to pressure in the body. A shifting sleeve in the body is releasably held in a position closing the port, and a normally opened valve connected to the sleeve is closed in response to a pressure increase on the orifice. Closing of the valve stop fluid flow and shifts the sleeve to an open position.

5 Claims, 3 Drawing Figures

CIRCULATING KILL VALVE

BACKGROUND OF THE INVENTION

It is well known to utilize a sleeve valve as a kill valve for initially closing a port in the valve. In the event that it is desired to pump kill fluid into the annulus of a well a ball is dropped down the well conduit to engage a seat in the sleeve and shift the sleeve to an open position. Thereafter fluid flow can be pumped through the port and into the annulus to kill the well and overcome a dangerous situation in the well. However, the actuation of the sleeve valve requires a time delay to insert an actuating ball at the well surface and drop it through the fluid in the conduit and down to the location of the seat on the sleeve. Furthermore, in some installations the well conduit may include various other equipment such as a depth indicator, which, while allowing fluid flow therethrough, will not allow the passage of a ball for actuating a sleeve valve.

Therefore, the present invention is directed to a circulating kill valve which allows the valve to open quickly and communicate fluid from the bore of a well conduit to the outside of the conduit for supplying the necessary volume of kill fluid. The present invention provides a circulating kill valve which is opened in response to an increase in fluid flow rate and therefore provides a kill valve which can be opened without requiring a valve actuator to be dropped from the well surface down to the location of the kill valve.

SUMMARY

The present invention is directed to a circulating kill valve for use in a well conduit and includes a body having a bore for receiving fluid flow therethrough in which the body has a port between the bore and the outside of the body. Valve means are provided in the bore initially closing the port and pressure responsive means in the bore actuates the valve means to open the port in response to increased fluid flow through the bore.

A still further object of the present invention is the provision of a circulating kill valve for use in a well conduit including a body adapted to be connected in a well conduit and having a bore for receiving fluid flow therethrough with a port between the bore and the outside of the body. A shifting sleeve is provided in the housing and releasing means are connected between the body and the sleeve for releasably holding the sleeve in a position closing the port. Normally open valve means is positioned in the bore and exposed to the fluid pressure and is connected to the sleeve. Pressure responsive means are provided in the bore and connected to the valve for closing the valve means in response to fluid flow and thereafter shifting the sleeve to a position opening the port.

Yet a still further object of the present invention is wherein the pressure responsive means is an orifice.

Still a further object of the present invention is wherein a drill bit having fluid openings is connected to the well conduit and the area of the orifice is substantially equal to the area of the fluid openings in the drill bit.

Yet a still further object of the present invention is the provision of resilient means acting on the valve means in a direction to open the valve means for normally allowing passage of fluid flow. Preferably this resilient means is adjustable for adjusting the force required to close the valve means.

Yet a still further object of the present invention is the provision of resilient means between the body and the sleeve for moving the sleeve away from the port after release of the releasing means.

Yet a still further object of the present invention is wherein the flow area through the open valve means is greater than the flow area through the orifice.

Other and further objects, feature and advantages will be apparent from the following description of a presently preferred embodiment of the invention, given for the purpose of disclosure and taken in conjunction with the accompanying drawings.

DESCRIPTION OF THE PREFERRED EMBODIMENT

While the present invention will be described in connection with its use in a drilling string, the present invention may be used in other types of well conduits.

Figure 1:
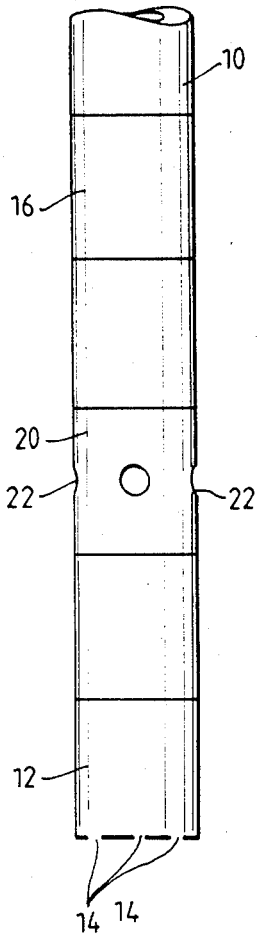
FIG. 1 is a schematic elevational view of the present invention used in a well drilling conduit.

Referring now to FIG. 1, the reference numeral 10 generally indicates a well conduit such as a drilling string having a conventional drilling bit 12 connected to the bottom thereof. Drilling fluids are circulated downwardly through the conduit 10 and out of the drill bit through conventional drill bit openings 14 and up the outside of the conduit 10 to the well surface. However, it may be necessary in some situations to quickly pump the drilling fluid into the well to kill the well and overcome pressure conditions in the well such as in the event that the drilling fluids drain into a well formation. Various types of circulating valves have been provided which open a side port in the well conduit, which is larger than the bit openings 14 for quickly pumping kill fluid into the well. Generally, such conventional kill valves are operated by dropping a ball or actuator down the interior of the drill string 10 to actuate a kill valve such as a sleeve valve. However, this creates a time delay. In addition, many drilling strings include a depth indicator instrument 16 which, while allowing the passage of drill fluid, does not allow for the passage of a ball for actuation of a valve therebelow.

The present invention is directed to a circulating kill valve generally indicated by the reference numeral 20, having one or more ports 22, which may be positioned below the depth indicator 16, which does not require actuation by a dropping ball but is actuated by an increase in the fluid flow rate through the drilling string 10.

Figure 2A:
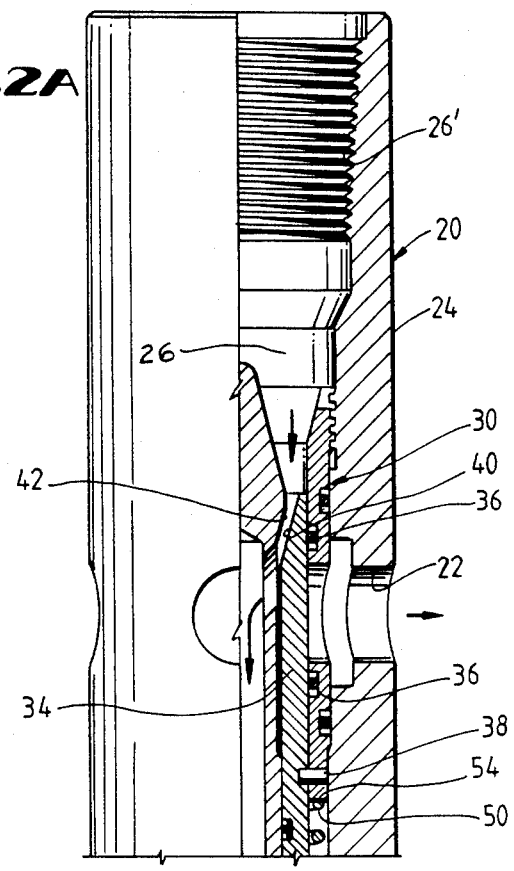
FIGS. 2A and 2B are continuations of each other and are enlarged quarter section views of the circulating kill valve of the present invention.
Figure 2B:
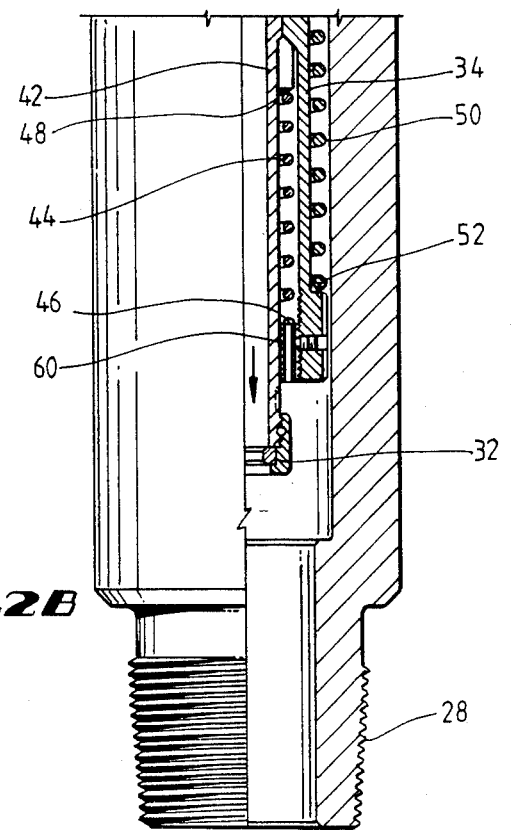

Referring now to FIGS. 2A and 2B, the valve 20 of the present invention includes a body 24 having suitable connections such as threads 26 at the top and 28 at the bottom for connection in a suitable well conduit. The body 24 includes a bore 26 therethrough for the passage of fluid flow. One or more ports 22 are connected between the bore 26 and the outside of the body 24 for pumping fluid from the bore 26 to the outside of the valve 20.

Valve means generally indicated by the reference numeral 30 are provided for initially closing the port and pressure responsive means 32 (FIG. 2B) such as an orifice are provided in the bore 26 for actuating the valve means 30 to open the port in response to an increase fluid flow through the bore 26.

The valve means 30 may include a shifting sleeve 34 in the body 24 which is initially held in a position closing the port 22. Thus the shifting sleeve 34 is in an upward position engaging seals 36 and isolating the port 22 from the bore 26. Releasing means 38 such as a shear pin is connected between the body 24 and the sleeve 34 for holding the sleeve initially in a position closing the port 22. Normally open valve means is provided in the bore and is connected to the sleeve 34 and normally permits flow of fluid through the bore 26. The valve means may include a valve seat 40 on the sleeve 34 and a movable valve element 42.

As best seen in FIG. 2B, a yieldable means such as spring 44 is provided between a shoulder 46 connected to the sleeve 34 and a shoulder 48 connected to the valve element 42 for normally holding the valve element 42 off of the seat 40 thereby permitting fluid passage therethrough. However, other types of valve seats and valve elements may be used such as a flapper valve and flow tube type valve.

The orifice or pressure responsive means 32 is connected to the valve element 42 and upon an increase in flow rate creates a differential pressure force across the orifice 42 to move the orifice 32 downwardly against the action of the spring 44 and seat the valve element 42 upon the valve seat 40 thereby blocking off downward fluid flow through the bore 26. With the closure of the valve element 42 on the seat 40 fluid pressure in the bore 26 thereabove forces the valve element 42 and seat 40 downwardly to move the shifting sleeve 34 downwardly shearing the shear pin 38. Thereafter, pressure and resilient means such as a spring 50 which acts against a shoulder 52 on the sleeve 34 and a shoulder 54 on the body 24 causes the shifting sleeve 34 to move downwardly thereby opening the port 22. Thereafter, kill fluid can be circulated down the well conduit through the bore 26 and out of the port 22.

Preferably, the area of the orifice 32 is substantially equal to the area of the fluid openings 14 of the drill bit 12 so as not to restrict fluid flow through the drill bit. Also preferably the flow area through the opening between the valve element 42 and seat 40 is larger than the area through the orifice 32.

Referring now to FIG. 2B, an adjusting nut 60 is provided engaging the spring 44 and is adjustably connected to the sleeve 34 for varying the force of the spring 44 thereby varying the flow rate required to seat the valve element 42 upon the valve seat 40.

Therefore, the valve 20 of the present invention can be actuated merely by increasing the flow rate of the drilling fluid through the conduit 10 which acts on the orifice 32 to close the valve thereby shearing the pin 38 and shifting the shifting sleeve to the open position.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A circulating kill valve adapted to be positioned in a well drilling string above a drill bit comprising, a body having a bore for allowing the passage of fluid through the drilling string to a drill bit, said body having a port between the bore and the outside of the body, a sleeve valve having a tubular sleeve telescopically movable in the bore, releasing means between the body and the sleeve releasably holding the sleeve in position closing the port, valve means in the bore including a valve seat on the sleeve and a movable valve element above the seat, resilient means yieldably holding the valve means in the open position, pressure responsive means in the bore and connected to the valve element for seating the valve element on the seat on the sleeve in response to increased fluid flow downwardly through the bore thereby shifting the sleeve downwardly to a position opening said port.

2. The apparatus of claim 1 including means adjusting the force of the resilient means.

3. The apparatus of claim 1 wherein the pressure responsive means is an orifice.

4. The apparatus of claim 3 including a drill bit having fluid openings therein and the area of said orifice being substantially equal to the area of the fluid openings in the drill bit.

5. The apparatus of claim 3 wherein the flow area through the open valve means is greater than the flow area through the orifice.

* * * * *